US005083679A

United States Patent [19]

Plough

[11] Patent Number: 5,083,679

[45] Date of Patent: Jan. 28, 1992

[54] DISPENSER FOR HOLDING AND SELECTIVELY SUPPLYING ONE OF TWO SPICES THEREIN

[76] Inventor: Harold Plough, 2000 W. Illinois Ave., Apt. 214, Aurora, Ill. 60506

[21] Appl. No.: 731,158

[22] Filed: Jul. 15, 1991

[51] Int. Cl.[5] ..... A47G 19/24

[52] U.S. Cl. ..... 222/142.1; 222/196.5; 222/564

[58] Field of Search ..... 222/142.1-142.9, 222/196.5, 457.5, 459, 484, 564, 196.1

[56] References Cited

U.S. PATENT DOCUMENTS

| | | | |
|---|---|---|---|
| 1,674,233 | 6/1928 | Williams | 222/142.1 |
| 1,927,149 | 9/1933 | Belefant | 222/142.4 |
| 2,135,848 | 11/1938 | Sandstrom | 222/142.4 |
| 2,173,542 | 9/1939 | Simington | 222/142.4 |
| 2,395,613 | 2/1946 | Crowell | 222/142.1 X |
| 2,606,691 | 8/1952 | Lindly | 222/142.2 |
| 2,734,663 | 2/1956 | Lucas | 222/142.1 |
| 2,812,114 | 11/1957 | Atrill | 222/142.4 |
| 4,721,232 | 1/1988 | Federighi | 222/196.5 |

*Primary Examiner*—Michael S. Huppert
*Assistant Examiner*—Anthoula Pomrening
*Attorney, Agent, or Firm*—Kajane McManus

[57] ABSTRACT

The dispenser holds two spices therein and selectively dispenses one of the spices at a time from a top surface thereof. The dispenser includes a parabolic, oval casing having a top surface formed of two planar members which each engage an upright. Each top surface member includes a recess in the area of the upright which creates a transverse slit in an area adjacent the upright, the slits being separated from one another by the upright. The upright continues downwardly, along the length of the casing to divide the interior of the casing into two sections. Each section further includes a slotted radially outwardly directed flange element extending from the upright across the horizontal extent of the section. The flange element controls the rate of dispensing and assists in returning any unused spice to the storage section of the chambers below the flange. Further, a clapper is provided within a base of the dispenser which acts to keep the spices from damming up behind the slits, creating an even, free flow of the spices.

3 Claims, 2 Drawing Sheets

DISPENSER FOR HOLDING AND SELECTIVELY SUPPLYING ONE OF TWO SPICES THEREIN

BACKGROUND OF THE INVENTION

The present invention relates to a spice dispenser adapted to hold two spices therein and selectively dispense one of the spices at a time, as desired. More particularly, the dispenser provides either salt or pepper from a substantially planar top surface thereof, without allowing combination of the spices, either within the dispenser or during dispensing of same, with structure being provided to prevent damming of the spice at an outlet to assure a free flow thereof.

PRIOR ART

Heretofore various dispensers for holding and dispensing more than one spice per single dispenser have been proposed.

For example, the Gebhardt U.S. Pat. No. 942,138 discloses a condiment shaker designed to hold both salt and pepper, or two other such condiments therein in separate compartments. The shaker includes a cylindrical receptacle divided into two compartments by a central vertical partition and includes a semispherical cap. Secured to each side of the partition is a downwardly inclined partition at a position along the top half of the central partition. The cap includes rows of perforations on each side of a central unperforated zone and upon shaking action, and turning the shaker on one side, a condiment in a then lower compartment exits the perforations aligned therewith while the condiment in the upper compartment engages the inclined partition and does not flow past it, being kept from reaching its corresponding perforations.

The Schneider U.S. Pat. No. 1,362,442 discloses a combined salt and pepper shaker which includes a body divided into two vertical sections by a centrally arranged partition. An upper portion of the body is provided with a pair of outwardly directed necks through which the content of a corresponding section may be shaken when a chosen neck is downwardly directed. To ensure that only one condiment is discharged at a time, downwardly inclined baffles are engaged to each side of the vertical partition creating a restricted discharge path in each vertical section.

The Blum U.S. Pat. No. 1,085,660 discloses a salt and pepper shaker comprising a cylindrical hollow body, the interior of which is divided by a medial longitudinally extending partition into two compartments. An open end of the body is closed by a removable circular closure which includes two sets or lines of discharge openings inclined or angularly disposed therein, with inner ends of the passages registering with an outer edge of the partition when the closure is in an operative position thereof. To prevent commingling of the spices, the edge of the partition is provided with V-shaped recesses on opposite sides thereof which register with the passages.

The Hart et al. U.S. Pat. No. 1,765,152 discloses a condiment holder for two separate powdered substances. Two different sized compartments are provided, each having a discharge spout and downwardly angled baffle walls therein for restricting the flow of substance to a respective discharge spout upon inversion of the holder and for preventing moisture from entering the compartment. The discharge spouts are at opposed circumferential locations along an upper area of a sidewall surface of the holder.

The Bounds U.S. Pat. No. 4,193,521 discloses a dual condiment dispenser having two separate compartments for use in separately dispensing two different condiments, such as salt and pepper. A container is divided into two separate compartments by means of a partition which runs vertically between the bottom and the top thereof. The top of the compartment is covered by a cap member which is removably attached thereto by suitable means, such as an interference fit. One or more apertures are formed in opposite portions of the sides of the cap member to form a condiment pouring outlet for each of the compartments. A baffle member is formed in the cap member opposite each of the outlets, each of the baffle members partially surrounding its associated outlet and having triangularly cross-sectioned deflector portions. The apices of the deflector portions are positioned directly opposite the apertures such that when the condiment is being shaken out of one of the compartments, the baffle will tend to prevent the condiment in the other of the compartments from being shaken out of its outlet.

Two other similar compartmented dispensing containers are disclosed in the Cianciolo U.S. Pat. No. 3,323,683 and the Vendel U.S. Pat. No. 1,954,719, each having the dispensing apertures thereof built into sidewalls of the dispenser body.

As will be described in greater detail hereinafter, the spice dispenser of the present invention provides a top dispensing surface, which provides for dispensing of one chosen spice at a time therefrom, providing unique interior isolator elements for isolating the spices from one another, both during storage and dispensing of the spices, as well as providing structure for assuring free flow of the spices therein when the dispenser is used in the manner to be described hereinafter.

SUMMARY OF THE INVENTION

According to the invention there is provided a dispenser for holding two spices therein and selectively dispensing one of the spices at a time from a top surface thereof. The dispenser includes a parabolic oval casing having a top surface which angles slightly upwardly between narrow ends of the oval. The top surface is formed of two planar members which each engage an upright. Each top surface member includes a recess in the area of engagement to the upright which creates a .transverse slit in an area adjacent the upright, the slits being separated from one another by the upright which continues downwardly, along the length of the casing, to divide the interior of the casing into two sections. Each section further includes a slotted flange element extending thereacross, the flange element controlling the rate of dispensing as well as assisting in returning any unused spice to the storage area below the flange. Further, the dispenser is provided with a clapper in a bottom section thereof which creates a concussive effect within the dispenser upon shaking thereof to keep the spices from damming up at the slits.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
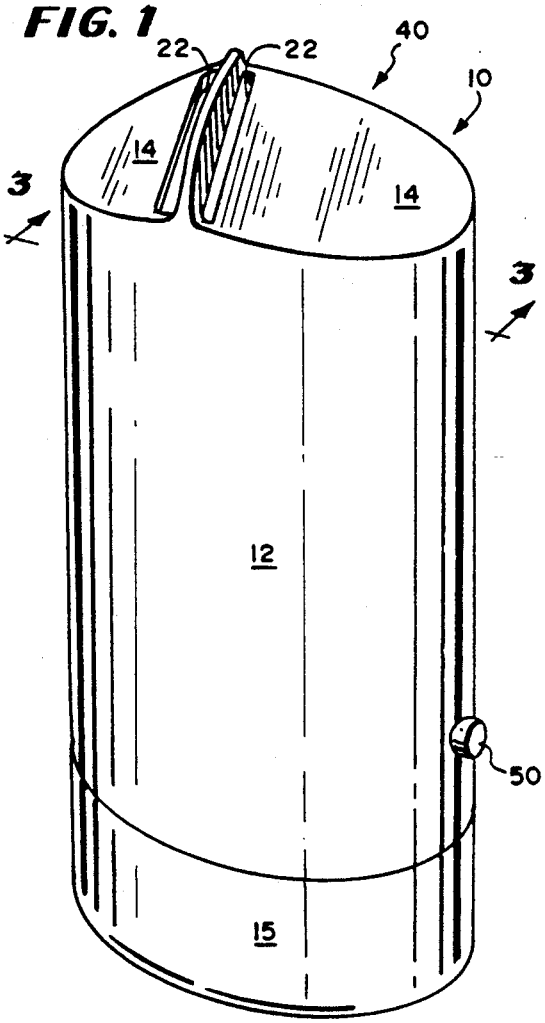
FIG. 1 is a perspective view of a preferred embodiment of the spice dispenser of the present invention.
Figure 2:
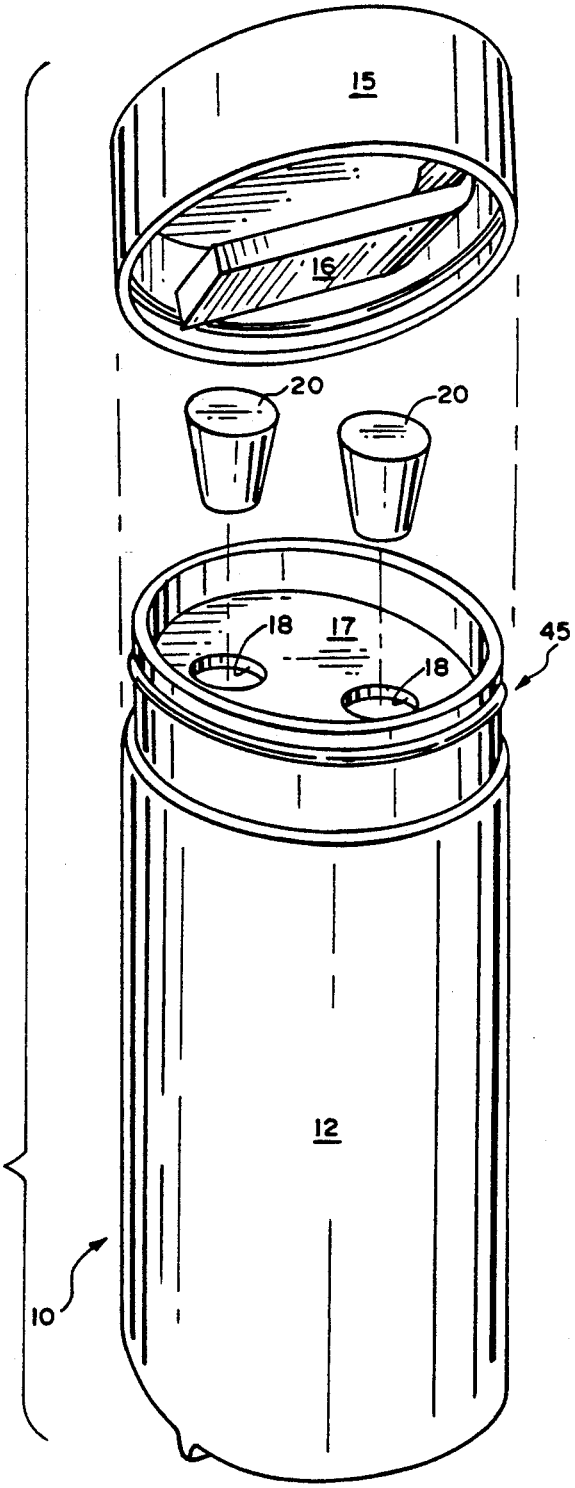
FIG. 2 is an upside down exploded perspective view of the spice dispenser and shows a bottom cover thereof disengaged to show the clapper element, fill apertures and closures of the dispenser.

Referring now to the drawings in greater detail, there is illustrated in the drawings a two spice dispenser 10 made in accordance with the teachings of the present invention.

The spice dispenser 10 includes an elongate oval casing 12 including two planar top surface forming sections 14 and a bottom cover member 15 within which a clapper 16 is hingedly engaged. The casing 12 also includes a bottom wall 17 within which fill holes 18 are provided, the fill holes 18 being sealed by stoppers 20.

The top surface forming sections 14 are slightly upwardly angled in the preferred embodiment and meet at a point between ends of the oval.

Each section 14 has a laterally extending slit 22 therein, the slits 22 being parallel to one another.

The slits 22 are spaced apart by, and located to either side of, an upright or dam member 24 which extends down the length of the casing 12, defining within the casing 12, two parallel upper upright chamber sections 26 and 28.

Each chamber section 26 and 28 is further divided into two vertical portions 30 and 32 by a flange member **33*a* and 33*b*, respectively, extending from the dam 24 to the periphery of the respective chamber section 26, 28, such periphery being created by an interior surface 29 of the casing 12**.

Each flange member **33*a*, 33*b* is horizontal or angled slightly upwardly and is seen to include an opening 34 at an edge 36 thereof which abuts the interior surface 29 of the casing 12, the opening 34** being rectangular and positioned approximately centrally along the semicircular portion of the periphery.

Turning now to the differences between the flanges **33*a* and 33*b*, it will be seen that the flange 33*b* within the chamber section 28 has a greater extent than the extent of the flange 33*a* in the chamber section 26**.

The need for this disparity in extent is created by the chamber 28 having a lateral extent greater than that of the chamber 26.

In this respect, the tendency for using a greater amount of one spice, such as salt, in contrast to the amount of spice used for a spice such as pepper, is accommodated by creating one larger chamber 28 and one smaller chamber 26, although this should not be construed as limiting.

When the dispenser 10 is placed into use, a decision must first be made as to which spice is to be dispensed. This is easily accomplished inasmuch as the casing 12 includes primary tactile indicia 40, either alone or in combination with visual indicia (not shown) which may be provided on the casing 12, to indicate which spice is located within which chamber section 26, 28. The tactile indicia 40 in the preferred embodiment are provided by the disparate length of the top surface forming elements 14.

Figure 4:
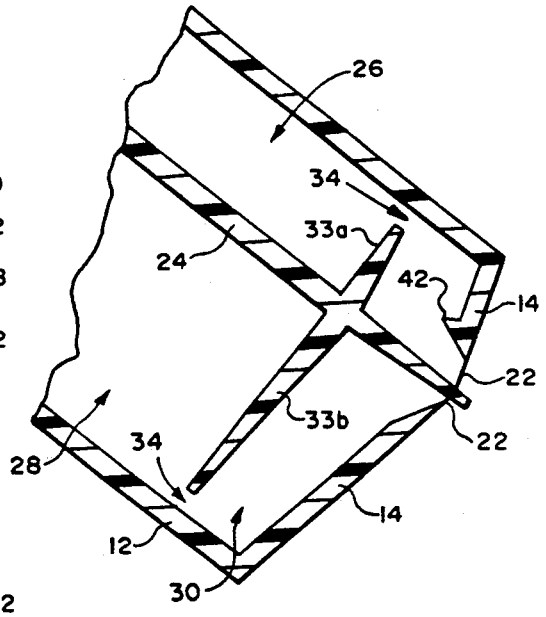
FIG. 4 is a cross sectional view through a top section of the spice dispenser with the dispenser positioned for provision of one spice therein.

Once the decision has been made, a user tilts the dispenser 10 in a manner to place, for example, the shorter element 14 upwardly, as shown in FIG. 4 choosing the associated spice and placing the corresponding slit 22, leading to the chosen chamber section 26, vertically above that of the other chamber 28.

The level of the chosen spice in the chamber section 26 rises against a back side of flange **33*a* and then exits the lower holding portion 32 of the chamber section 26 exiting through the opening 34 in the flange 33*a* and then runs downwardly and falls out of the corresponding slit 22**.

The spice in the opposite chamber section 28 obviously also pours through opening 34 in its corresponding flange **33*b* but rather than falling out, merely collects within the collection chamber 30 formed between the flange 33*b* and the top surface element 14 of the casing 12**.

Figure 5:
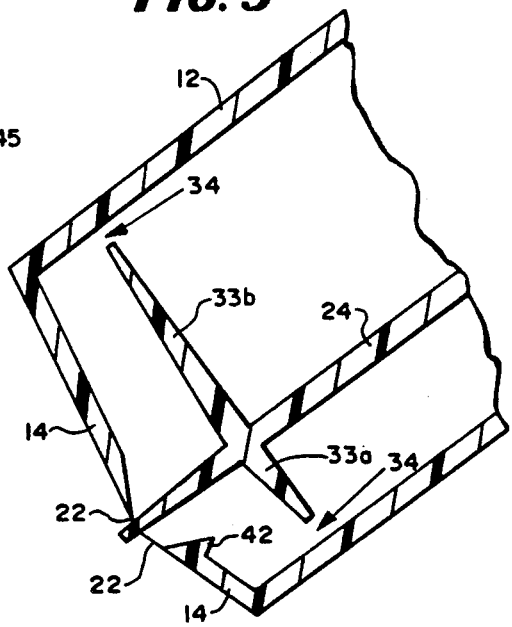
FIG. 5 is a cross sectional view through the top section of the spice dispenser with the dispenser positioned for provision of the second spice therein.

FIG. 5 shows that when the other spice is desired, one merely tips the dispenser 10 in the other direction creating a like effect to that just described above. Here, however, because of the shorter lateral extent of top surface forming element 14, it has been provided with a short depending terminal lip 42 to assure no leakage of the spice from the corresponding chamber 30.

Figure 3:
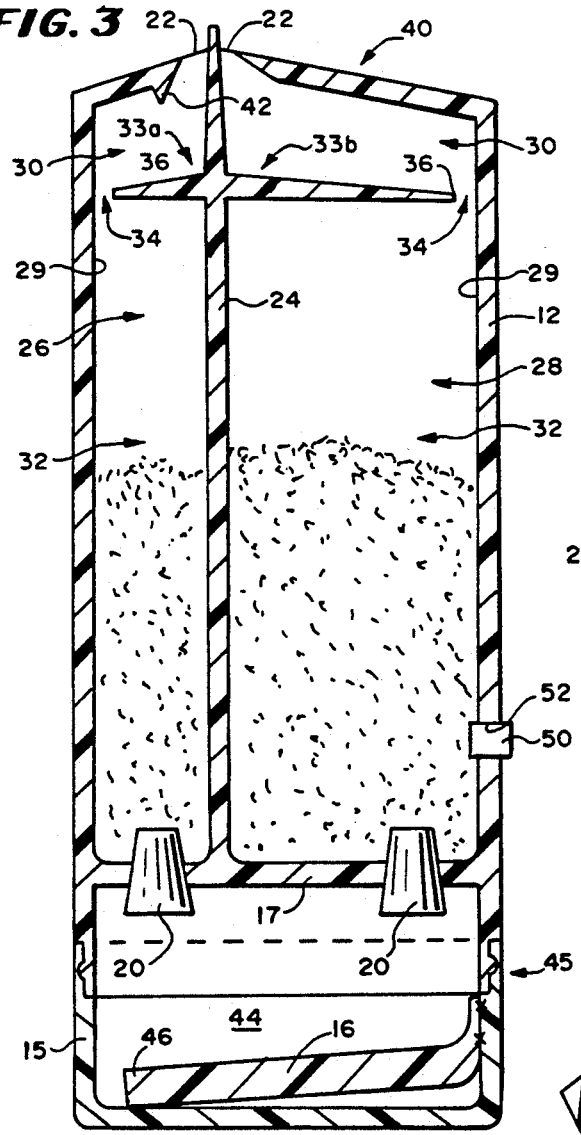
FIG. 3 is a cross sectional view through the spice dispenser and is taken along line 3—3 of FIG. 1.

Upon returning the dispenser 10 to its usual upright position as shown in FIG. 3 the spices within the collection chamber portions 30 of each chamber section 26, 28 flow back along the respective flanges **33*a*, 33*b* through the opening 34 therein, and back into the holding portions 32 of the chamber sections 26 and 28**, without contamination of one spice by the other.

Figure 6:
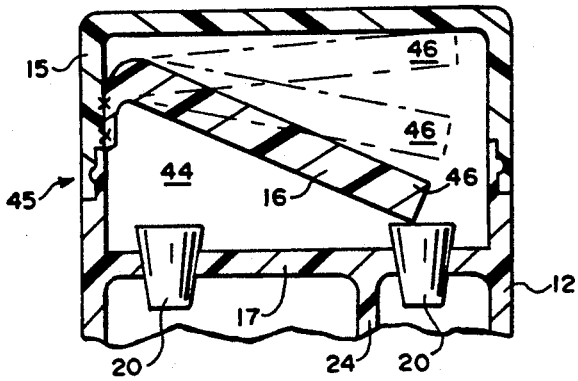
FIG. 6 is a cross sectional view through the bottom section of the dispenser and shows the clapper functioning during shaking of the dispenser.

FIG. 6 shows the clapper 16 of the dispenser 10 in action. The clapper 16 is dependingly engaged within and to the bottom cover 15 of the dispenser 10.

A bottom chamber 44 is defined within the bottom cover 15 which engages onto a bottom portion of the casing 12 for the dispenser 10 in suitable manner such as by snap fit engagement as shown at 45.

The bottom cover 15 when removed allows access to the bottom wall 17 of the casing 12, such bottom wall 17 having the fill openings 20 therein which may be closed in suitable manner, such as by having a cork stopper 20 secured therein.

Upon shaking of the dispenser 10, the clapper 16 pivots about its hinged engagement to the bottom cover 15 and a free end 46 thereof claps against a corresponding cork stopper 20 thereunder. These small concussions created by the clapper 16 against the stopper 20 have been found, by empirical testing, to overcome the damming effect of a spice, such as pepper, behind its corresponding outlet slit 22 to keep the spice freely flowing. The clapper 16 may be, if desired, made of magnet material and may be used for securing the dispenser 10 to a metal surface, such as a stove top or counter.

The casing is also seen to have engaged thereto a further stopper or plug member 50 which seals a port 52 leading to larger chamber 28. Because this plug member 50 extends outwardly of the casing 12 in a grasping area thereof, the plug member 50 provides further or secondary tactile indicia for identifying chamber 28.

The purpose for providing the plug member 50, however, is twofold. Not only does the plug member 50 serve as tactile indicia, but it also serves as a fill indicator.

In this respect, it is preferable to leave a portion of the chamber 28 unfilled when a spice such as salt is placed therein. Accordingly, during filling of chamber 28, the plug member 50 is removed, and when the level of spice reaches the level of port 52, filling of the chamber 28 is accomplished and the plug member 50 is reinserted to seal port 52.

As described above, the dispenser 10 has a number of advantages, some of which have been described above and others of which are inherent in the invention.

Also, modifications can be proposed to the dispenser 10 without departing from the teachings herein. For example, a closure member for the slits 22 could be provided for ease of filling. Accordingly the scope of the invention is only to be limited as necessitated by the accompanying claims.

I claim:

1. A spice dispenser for holding two spices therein and for dispensing only one spice at a time, the dispenser comprising: an oval, parabolic casing including planar top surface portions; a dam extending vertically from a base of the casing upwardly to a level slightly above the top surface of the casing, said dam extending across the narrow extent of the oval. casing, and being located at a position between the oval ends thereof to form two chambers within the casing; said planar top surface portions engaging said dam, each said top surface portion including a recess in an area adjacent said dam to form two parallel spaced apart traverse slits in the top surface of the casing, each slit leading to a respective chamber therebeneath; each chamber further including a flange therein extending radially outwardly from said dam to a periphery of the chamber, each flange including an opening therein lying adjacent to the to the periphery of the chamber.

2. A spice dispenser for holding two spices therein and for dispensing only one spice at a time, the dispenser comprising: an oval, parabolic casing including planar top surface portions, a dam extending vertically from a base of the casing upwardly to a level slightly above the top surface of the casing, said dam extending across the narrow extent of the oval casing, and being located at a position between the oval ends thereof to form two chambers within the casing; said planar top surface portions engaging said dam, each said top surface portion including a recess in an area adjacent said dam to form two parallel spaced apart traverse slits in the top surface of the casing, each slit leading to a respective chamber therebeneath; each chamber further including a flange therein extending radially outwardly from said dam to a periphery of the chamber, each flange including an opening therein lying adjacent to the periphery of the casing and said casing including a bottom cover defining a bottom chamber having a clapper therein which claps against a bottom closure surface of said casing upon shaking of the dispenser.

3. A spice dispenser for holding two spices therein and for dispensing only one spice at a time, the dispenser comprising: an oval, parabolic casing including planar top surface portions; a dam extending vertically from a base of the casing upwardly to a level slightly above the top surface of the casing, said dam extending across the narrow extent of the oval casing, and being located in a position between the oval ends thereof to form two chambers within the casing; said planar top surface portions engaging said dam, each said top surface portion including a recess in an area adjacent said dam to form two parallel, spaced apart traverse slits in the top surface of the casing, each slit leading to a respective chamber therebeneath; each chamber further including a flange therein extending radially outwardly from said dam to a periphery of the chamber, each flange including an opening therein lying adjacent to the periphery of the casing; said casing including tactile indicia for outwardly indicating the identity of a corresponding chamber, said indicia further indicating a fill level for one chamber; and said dispenser further including a clapper in a bottom chamber formed by a bottom cover, the clapper clapping against a bottom closure surface of said casing when the dispenser is shaken.

* * * * *